United States Patent [19]

Branigin

[11] 3,947,531

[45] Mar. 30, 1976

[54] CARBURETOR WITH CONTROLLED FAST IDLE CAM

[75] Inventor: Charles D. Branigin, Britton, Mich.

[73] Assignee: Ford Motor Company, Dearborn, Mich.

[22] Filed: Dec. 23, 1974

[21] Appl. No.: 535,522

[52] U.S. Cl. ..... 261/39 B; 261/39 E; 261/52

[51] Int. Cl.[2] ..... F02M 1/12

[58] Field of Search ..... 261/52, 39 B, 39 E

[56] References Cited

UNITED STATES PATENTS

| | | | |
|---|---|---|---|
| 1,996,245 | 4/1935 | Hunt | 261/39 B |
| 2,124,778 | 7/1938 | Hunt | 261/52 |
| 2,262,408 | 11/1941 | Read | 261/39 B |
| 2,943,848 | 7/1960 | Gordon et al. | 261/52 |
| 3,185,453 | 5/1965 | Mennesson | 261/52 |
| 3,263,972 | 8/1966 | Braun et al. | 261/52 |
| 3,279,771 | 10/1966 | Herman et al. | 261/52 |
| 3,494,598 | 2/1970 | Gordon | 261/39 B |
| 3,752,133 | 8/1973 | Irish et al. | 261/39 E |

*Primary Examiner*—Tim R. Miles

*Attorney, Agent, or Firm*—Robert E. McCollum; Keith L. Zerschling

[57] ABSTRACT

The carburetor has a fast idle cam latch to prevent movement of the cam to a normal idle speed position, upon throttle valve kick-down operation, when the temperature is below a set level, to prevent engine stalling; the latch consisting of a bimetallic leaf spring in the path of movement of a finger attached to the cam, the spring being movable out of the path of the cam finger when the temperature is above the set level.

1 Claim, 7 Drawing Figures

CARBURETOR WITH CONTROLLED FAST IDLE CAM

This invention relates in general to a motor vehicle type carburetor and more particularly to the fast idle cam associated with the cold enrichment system for the carburetor.

Most carburetors contain a cold enrichment system that includes a choke valve controlled in its movement by a bimetallic coiled spring as a function of temperature changes to gradually increase the air supply to the carburetor as the engine approaches normal operating temperatures. Also generally included is a fast idle cam mounted for cooperation with the choke valve to open the throttle valve to faster engine idle speed positions as the temperature decreases below a set level, in order to provide adequate air/fuel mixture volume during colder engine operation.

At the warmer ambient temperatures, after the engine has started with the fast idle cam position at its highest setting, the driver or operator frequently will rapidly depress and release the accelerator pedal in a well known "kick-down" operation, to release the fast idle cam from the high cam setting to move the throttle valve to a less open idle speed position, and one commensurate with the required volume of air/fuel mixture. This particular operation involves, in a conventional construction, opening the throttle valve which releases a screw engagement with the cam surface of the fast idle cam and at the same time allows the fast idle cam to fall by gravity to whatever position is dictated by the position of the choke valve against which it is operatively slaved. It also frequently happens that upon the sudden throttle valve depression, the rush of air through the induction passage at the higher ambient temperature levels, where the bimetal coiled spring force only lightly biases the choke valve closed, is sufficient to swing the choke valve to a much larger opening than is desired. This then permits the fast idle cam to move to a much lower step position or even completely off the cam steps so that the sudden return of the throttle valve screw traps the fast idle cam in a position permitting the throttle plate to close to a normal engine operating temperature idle speed position. In this position, at this temperature level, insufficient air/fuel mixture would be inducted into the engine to provide the power necessary to overcome the friction forces at this temperature level, resulting in stalling of the engine.

It is a primary object of this invention to provide means to prevent the trapping of the fast idle cam in the manner indicated above during the operation of the engine within a predetermined temperature range, to prevent engine stalling.

It is another object of the invention to provide a latch or abutment means positioned in the path of the fast idle cam to resist its movement when the operating temperatures are below a set level, to prevent engine stalling.

It is a still further object of the invention to provide a carburetor with a cold enrichment system that includes a choke valve that is unbalance mounted in the carburetor induction passage to be opened by the flow of air against it, the choke valve being biased to a closed position by a bimetallic temperature responsive coiled spring force that increases with decreases in temperature below a predetermined level; the choke valve having a one-way connection with a fast idle cam having a cam surface engaged by means secured to the throttle valve for determining the closed position of the throttle valve as a function of temperature changes and choke plate position, and including a second temperature responsive device movable into the path of movement of the fast idle cam to restrict its movement below a predetermined temperature level to prevent the throttle valve from closing beyond a desired position due to accidental opening of the choke valve beyond a conventional position.

Other objects, features and advantages of the invention will become more apparent upon reference to the succeeding detailed description thereof, and to the drawings illustrating the preferred embodiment thereof; wherein.

Figure 1:
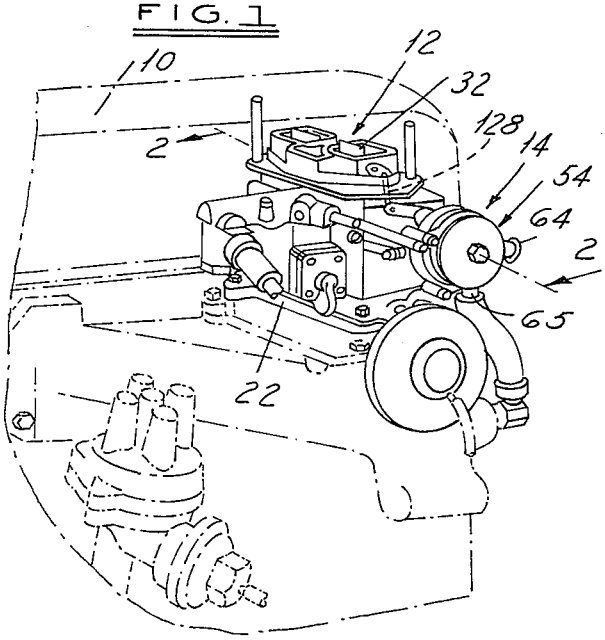
FIG. 1 is a perspective elevational view of an internal combustion engine and carburetor embodying the invention.
Figure 2:
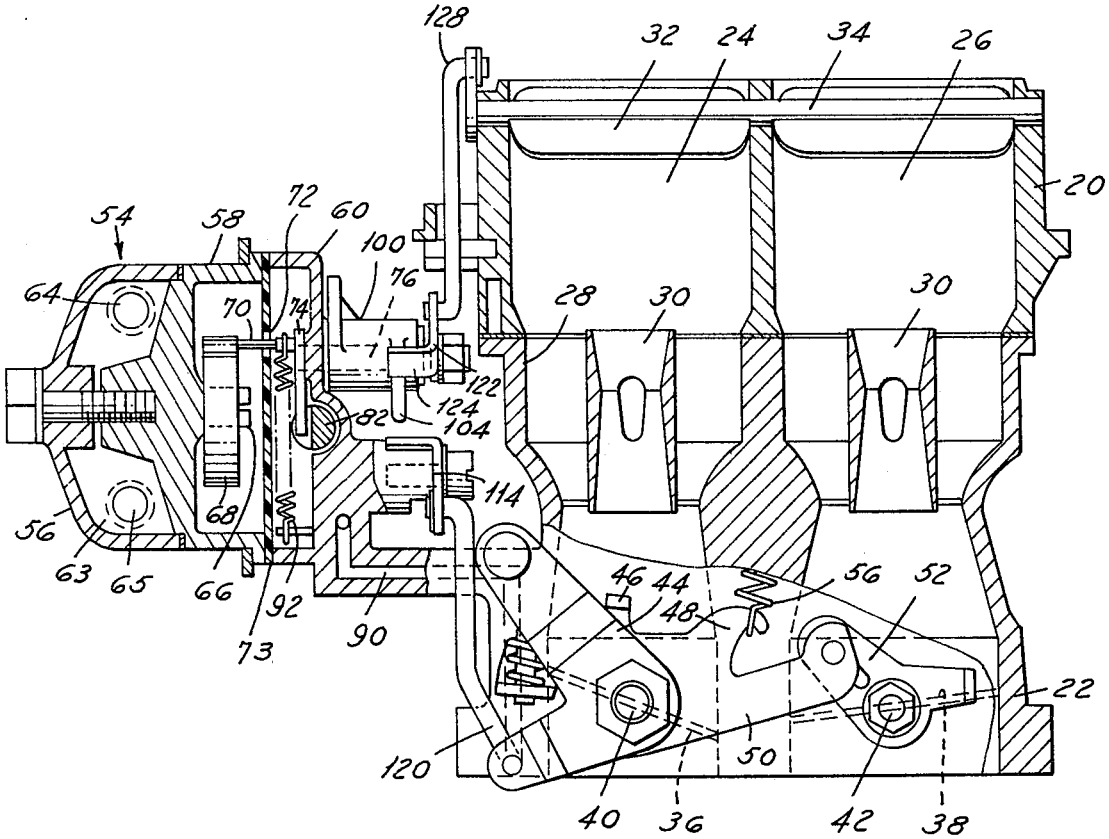
FIG. 2 is an enlarged cross-sectional view through the carburetor shown in FIG. 1, taken on a plane indicated by and viewed in the direction of the arrows 2—2 of FIG. 1.

FIG. 1 shows a portion 10 of an internal combustion engine. On it is mounted a two barrel carburetor 12 having a water heated automatic type choke 14 embodying the invention. FIG. 2 shows a cross sectional view of the carburetor. It is of the two stage downdraft type having an air horn portion 20 and a combined fuel metering and throttle body portion 22. The portions together define a primary induction passage 24 and a larger secondary induction passage 26. Each have fresh air intakes at the air horn end, and are connected to the engine intake manifold at the throttle body ends. Passages 24 and 26 each are formed with a main venturi section 28 containing a booster venturi 30 through which the main supply of fuel is adapted to be inducted in a known manner.

Air flow through each of the induction passages is controlled in part by a choke valve 32. The valve is unbalance mounted on a shaft 34 rotatably mounted on side portions of the carburetor air horn, as shown. Flow of fuel and air through each passage is controlled by conventional throttle valves 36, 38 fixed on shafts 40, 42 independently rotatably mounted in the throttle body portion 22. The primary throttle valve 36 is rotated open in a known manner by depression of a lever (not shown) fixed on shaft 40 and connected to the conventional vehicle accelerator pedal. The larger second stage throttle valve 38 is rotated open by the primary throttle valve through a lost motion linkage after a predetermined degree of rotation of the primary valve. More specifically, a lever 44 secured to throttle shaft 40 has an offset tang 46. When rotated clockwise, tang 46 engages a spring hook portion 48 of a lever 50 pivotally connected to a second lever 52 fixed on throttle shaft 42. A spring 56 normally urges both throttle valves to the closed idle speed position shown.

Figure 3:
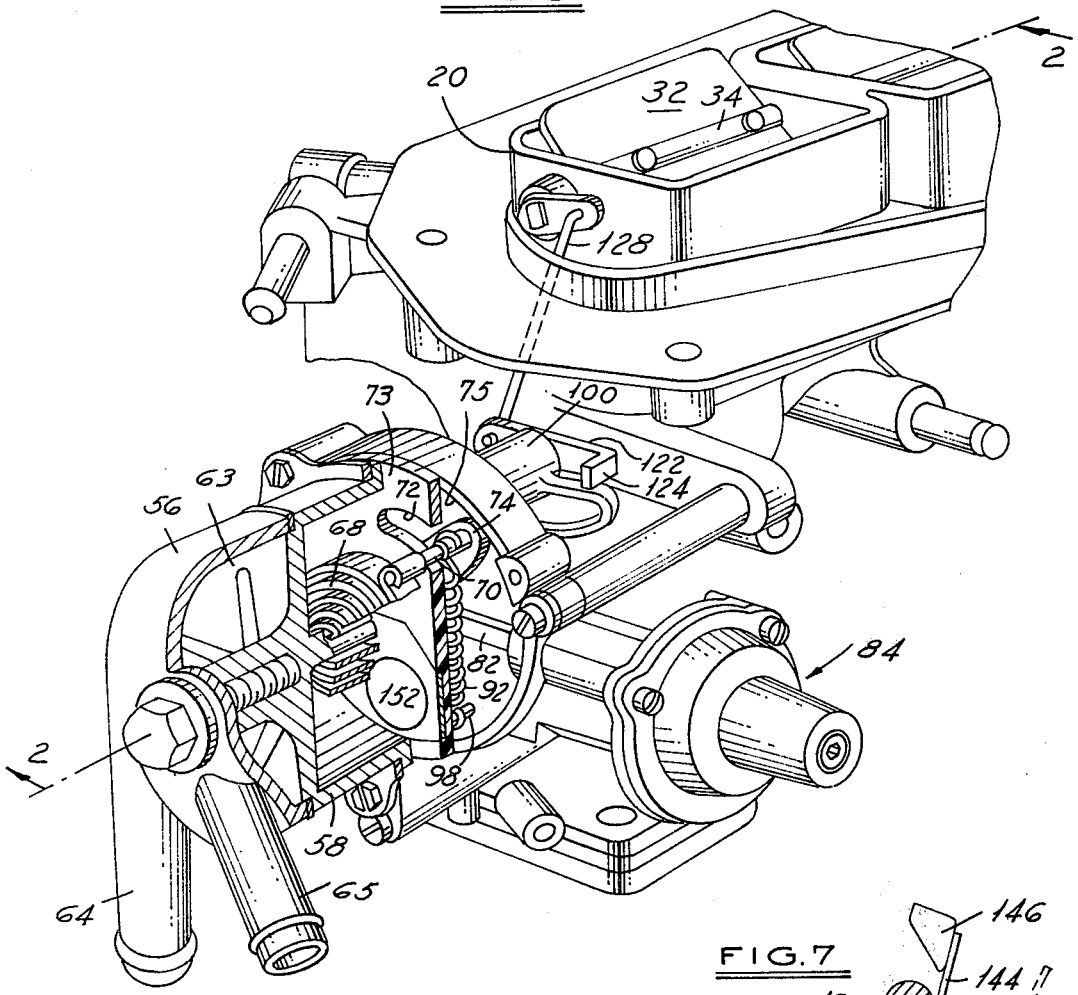
FIG. 3 is an enlarged perspective elevational view of portions of the carburetor illustrated in FIG. 1.

Choke valves 32 rotate from the closed position to a nearly vertical, inoperative position providing the minimum resistance to air flow. The position of the choke valves 32 is controlled in part by a semi-automatically operating choke mechanism 54. The latter includes a three-piece housing including a cap portion 56, an intermediate bimetal chamber portion 58, and an inner housing portion 60 bolted to the side of the carburetor body. The cap portion 56 and bimetal spring chamber portion 58 are separated by an annular heat conducting member 62 to define a water chamber 63 within a cap portion 56. As best seen in FIGS. 1 and 3, water from the engine cooling system is adapted to be circulated through the chamber by means of inlet and outlet tubes or conduits 64 and 65.

Figure 4:
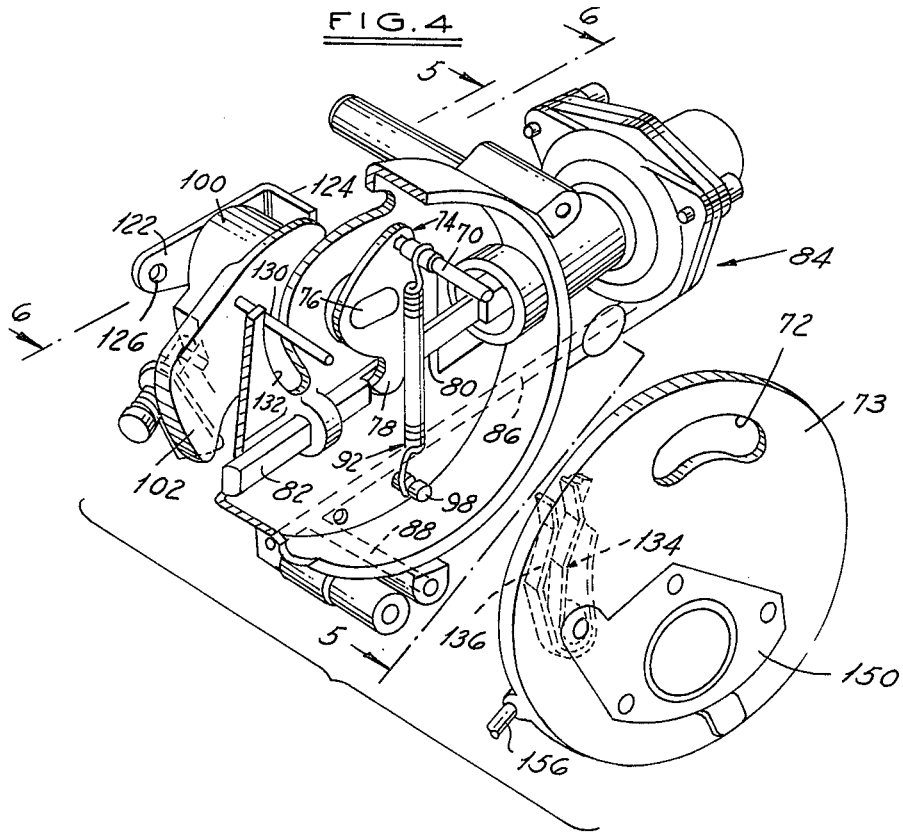
FIG. 4 is an enlarged perspective exploded view, with parts broken away and in section, of a portion of the automatic choke construction illustrated in FIG. 1.

The partition member 62 is formed with a slotted stub shaft 66 in which is mounted and anchored the inner end of a bimetallic, thermostatically responsive coiled spring 68. The outer end of the coil is secured to one end of a pin 70 that projects through an arcuate slot 72 in an insulating gasket 74. The gasket separates the bimetal chamber from the chamber 75 defined in the inner housing portion 60. The opposite end of shaft 70 projects from one end of a bell crank lever 74 pivoted on a shaft 76 projecting through the inner housing 60. The opposite end 78 of lever 74 is located in a slot 80 provided in a plunger 82 mounted for a sliding movement in the housing. The plunger is connected to a diaphragm type servo device 84 connected by a pair of vacuum lines 86 and 88 to a line 90 shown in FIG. 2 leading to the carburetor induction passage below the closed position of the throttle valve. This subjects the passages to manifold vacuum and causes the servo 84 to move the plunger rightwardly as seen in FIGS. 3 and 4 to rotate the lever 74 counterclockwise, for a purpose to be described later.

A tension spring 92 is attached at one end 94 over the pin 70 and anchored at its opposite end 96 to a pin 98 projecting from the housing. It should be noted that this spring is of the overcenter type. The circumferential movement of pin 70 in response to the contraction or expansion of the bimetallic coil 68 pivots the tension spring 92 about the fixed point 98 to its other overcenter position on the other side of the shaft 76. Accordingly, it will be seen that in the initial position shown, the biasing force of spring 92 is to pull lever 74 in a clockwise direction; whereas, in the opposite overcenter position on the other side of shaft 76, the force of tension spring 92 will be to urge lever 74 in a counterclockwise direction. This overcenter action occurs because of the location of the pivot 98 within the circumferential area defined by the movement of pin 70 and below the axis of shaft 76.

Figure 6:
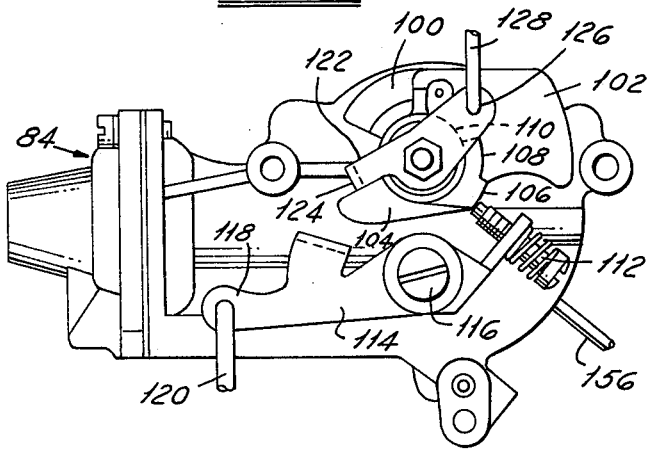
FIG. 6 is a side elevational view on a reduced scale of the back side of other details illustrated in FIG. 4 and taken on a plane indicated by and viewed in the direction of the arrows 6—6 of FIG. 4.

The shaft 76 projects through and beyond the wall of the inner housing 60 for rotatably mounting thereon a fast idle cam 100, more clearly seen in FIG. 6. Fast idle cam includes a weighted portion 102 and a cam surface portion 104, on opposite sides of shaft 76. The cammed surface includes a high cam step 106, a lower cam step portion 108 of less radial extent, and a lesser radial extent portion 110. Abuttingly and alternately engaging one or the other of the stepped portions of the cam is a screw 112 that is adjustably mounted to a lever 114. The latter is rotatably mounted at 116 on the inner housing 60 and is pivotally connected at 118 by a link 120 to the primary throttle valve link 50 shown in FIG. 2. The throttle valve return spring 56 normally pulls downwardly on the link 120 to abuttingly engage the screw 112 against the fast idle cam surface, as shown.

When the throttle valves are opened, the fast idle cam normally is free to rotate by gravity in a clockwise direction as seen in FIG. 6 to vary the idle speed position of the screw 112 as a function of temperature changes and choke valve opening. More particularly, attached to the end of shaft 76 is a choke valve lever 122 that has a tang 124 on one end abuttingly engageable with a surface on the fast idle cam 104. The other end of lever 122 is pivotally connected at 126 to a link 128 pivoted to the choke shaft 34. Thus, the rotative position of shaft 76 and the choke valve determine the position of the fast idle cam as a function of temperature changes of the bimetal coil 68.

At certain ambient temperature operating conditions, such as, for example, between 75°–80°F., the closing force of the bimetal spring 68 generally is weak. Accordingly, if the throttle plate were suddenly depressed and released, such as during a conventional kick-down operation, the fast idle cam may become trapped in a position locating the throttle plates in a normal idle speed position when the actual temperature conditions call for the throttle plates to be located in a more open position for cold engine operation. That is, assume that the throttle plates are suddenly opened. This opening by the throttle plate linkage pushes upwardly on link 120 in FIG. 6 to pivot lever 114 clockwise and move screw 112 away from the fast idle cam 104. With the weakened force of bimetal 68, the sudden inrush of air into the induction system past the choke valve 32 may "blow open" the choke valve thus causing a clockwise rotation of choke valve lever 122. This immediately releases the fast idle cam for a clockwise rotation by gravity to follow the choke valve lever 122, placing the fast idle cam in a position in which the lowest radial extent step 110 may be located opposite the screw 112 when the throttle plates are returned to the idle speed setting. This, of course, would reduce the volume of air/fuel mixture flowing into the engine, which with the increased friction at this lower temperature level, might be insufficient to support engine operation and result in stalling.

Figure 5:
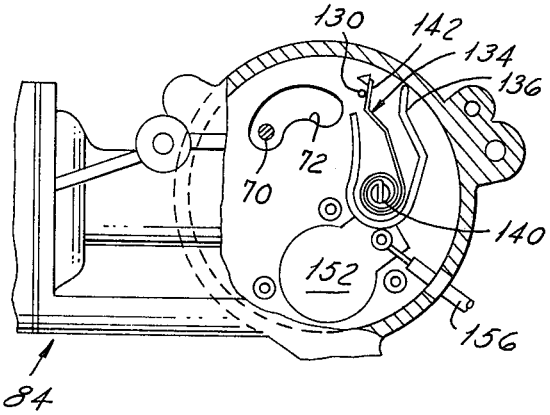
FIG. 5 is an elevational view on a reduced scale of the back side of a detail shown in FIG. 2 and taken on a plane indicated by and viewed in the direction of the arrows 5—5 of FIG. 4.
Figure 7:
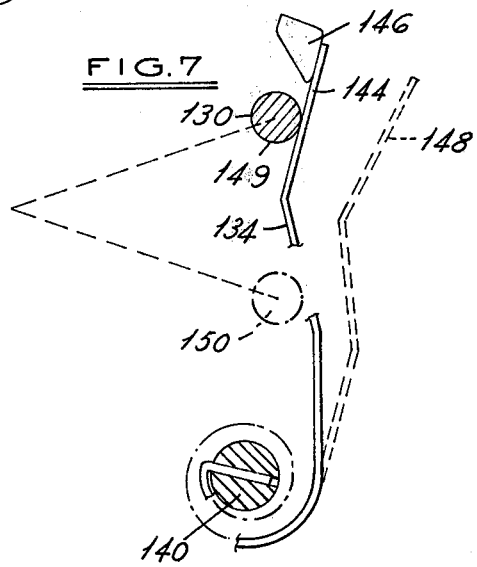
FIG. 7 is an enlarged view of a detail shown in FIG. 5, illustrating the detail in various operative positions.

To alleviate the above, the fast idle cam is formed with a latching device. This consists of a pin 130 that extends parallel to shaft 76 through an arcuate slot 132 in the outer choke housing 60 for a yielding engagement with a second bimetallic spring 134 shown in FIGS. 4 and 5. More specifically, the chamber 75 side of gasket 72 is formed with a trough-shaped projection 136 within which is mounted the bimetallic temperature responsive leaf spring element 134. The latter is mounted at its inner end in a slot in a pin or post 140 and has a finger-like outer portion 142. The latter is adapted to be engaged by the side of pin 130 secured to the fast idle cam. As seen in FIG. 7, the bimetal 134 is movable between a first position 144 against a stop 146 when temperatures are below a predetermined operating level, and a second position 148 when the temperature has increased and caused the bimetal to expand as shown. In moving to the alternate positions, the pin 130 moves from the upper position 149 to the lower position 150.

It will be seen, therefore, that under warmer but below normal operating temperature conditions as described above where the choke valve may be blown open at times, rotation of the fast idle cam and its pin 130 past the leaf spring 134 will be resisted so as to eliminate the possiblity of the fast idle cam being trapped in the manner previously described. At higher ambient temperatures, movement of the leaf spring 134 to the second position 148 will permit free rotation of the fast idle cam to permit closure of the throttle plates to their normal idle speed position, as would normally be dictated by this temperature level.

The bimetallic coil element 68 has operating characteristics that are a compromise to provide good cold engine choke closing and yet warm engine fast idle starts. This compromise necessarily means that the choke valve will come off slower than may provide good emission results. Accordingly, an electrical heater element 150 is added to supply additional heat to the bimetal temperatures to pull off the choke valve faster than it would come off by reason of the bimetal being responsive to engine temperature along. The heater in this case is a positive temperature coefficient (PTC) semiconductor in the form of a ceramic pill 152 that is self-regulating in output temperature to eliminate the necessity of providing a bimetal switch to shut off the heater output. That is, when energized, the internal resistance of the PTC element varies directly with the skin temperature increases and only slightly with the PTC internal temperature increases until a switching temperature at say 180°F., for example, is reached, at which point where there is no additional heat increase. The heat output in this case is transferred to the bimetal coil 68, and also through the post 140 to the leaf spring 134 causing it to move to the second position 148 faster than it would were it subjected to engine temperature heat alone.

The PTC element is connected electrically in this case to the engine voltage regulator through suitable wiring harness indicated generally at 156, to be energized whenever the engine is running. Of course, if desired, it could be selectively actuated to be energized at any temperature level.

In operation, at about 75° F., for example, prior to engine start, the bimetal 68 will have rotated pin 70, lever 74, and choke valve lever 122 clockwise as seen in FIG. 4 to a position urging the choke valve closed. At this temperature level, the bimetal force alone generally will be insufficient to fully close the choke valve for starting purposes. The additional force provided by the tension spring 92, however, is sufficient to positively move the choke valve to a closed position. The absence of vacuum in the servo 84 permits the servo spring, not shown, to return the plunger 82 to the left out of engagement with lever 74. The second leaf spring 134 also at this time is located in the cold latching position shown in FIG. 5.

Assume now that the engine is started. As soon as a running condition is obtained, manifold vacuum acting on servo 84 will pull plunger 82 to the right as seen in FIG. 4 and move lever 74 counterclockwise to positively crack open the choke valve a predetermined amount. This will lean the starting air/fuel mixture to that level needed for cold engine operation at this temperature. The moving of lever 74 by the servo also negates the effect of the tension spring 92.

Assume now that a kick-down operation is performed; that is, the primary throttle plate 36 is opened wide which pivots lever 114 and moves screw 112 away from the fast idle cam 104. If the temperature were quite low, the force of bimetal coil 68 alone would be sufficient to keep the choke plate from being blown open by the increased induction of air at this time. Therefore, the fast idle cam would not rotate freely clockwise, and in fact, may be rotated counterclockwise by the choke valve attempting to assume a more closed position to correspond to the temperature level. If, however, the temperature level is such that only a small force is exerted by the bimetal coil, then upon blowing open of the choke plates, the fast idle cam will move clockwise until the pin 130 abuts against the leaf spring 134, to be held in that position. Then upon return of the throttle plate 36 to the idle speed position, returning screw 112 to the position shown in FIG. 6, the fast idle cam will be in a position permitting only a slight reduction in the engine idle speed opening position of the throttle plate 36.

When the PTC heat output is sufficient, or the engine started at higher ambient temperatures, the leaf spring 134 will have moved to its other position 148 and out of the path of movement of the pin 130 secured to the fast idle cam. Then, when kick-down operation occurs, if the choke plates are blown open, the fast idle cam may rotate completely in a clockwise direction so that screw 112 is located opposite the step 110 when the primary throttle plates 36 are returned to an idle speed condition. Such a position, however, is correct for this temperature level since the engine will then be operating essentially at its normal operating temperature.

It will also be seen, therefore, that as the temperature of the bimetal 68 increases, the counterclockwise circumferential movement of the end of the bimetal and pin 70 rotates the lever 74 to move the tension spring 92 to its alternate overcenter position. The moment that the overcenter action occurs, the force of spring 92 instead of aiding the force of bimetal coil 68 then opposes that action and actually acts to open the choke valve rather than close it as in the previous condition. The tension spring 92 therefore has a dual function of operating at median temperature levels to positively close the choke valve for engine staring purposes and at higher levels to open the choke valve in opposition to the bimetal coil force attempting to close it.

While the invention has been shown and described in its preferred embodiments, it will be clear to those skilled in the arts to which it pertains that many changes and modifications may be made thereto without departing from the scope of the invention.

I claim:

1. A carburetor having an induction passage open at one end to air and adapted to be connected at its other end to the intake manifold of an internal combustion engine, a spring closed throttle valve mounted for rotation across the passage to control flow of air and fuel therethrough, an air movable choke valve unbalance mounted in the induction passage above the throttle valve and movable between a closed position and open positions by the flow of air thereagainst to control the air flow past the choke valve, a rotatable fast idle cam having a cam surface operatively engageable by a lever rotatable with the throttle valve, the fast idle cam being journalled for a free rotation by gravity on a shaft on which is secured a choke lever connected to the choke valve, the choke lever having a one-way interconnection with the cam permitting free rotation of the choke lever relative to the cam in a choke valve opening direction while restricting rotation of the cam past the choke lever in the same direction, a first chamber containing a bimetallic temperature responsive coiled spring connected to the choke valve lever biasing the choke valve closed and the fast idle cam in the same direction towards a highest fast idle position with a force that increases with decreases in temperature from a predetermined level, engine temperature sensitive heating means adjacent the coiled spring for warming the spring as a function of changes in engine temperature level to permit progressive opening of the choke valve and movement of the fast idle cam towards a lower fast idle speed position, a second chamber contiguous with the first chamber and having a common wall defined by a heat insulating gasket, a second bimetallic temperature responsive spring cantilever mounted in the second chamber so as to be insulated from the heating means in the first chamber with the free end of the second spring flexibly projecting into the path of movement towards the lower fast idle speed position of a pin projecting from the fast idle cam so as to be engagable by the pin below predetermined temperature levels to restrict further movement of the pin and cam in the choke valve opening direction even though permitted by an opening movement of the choke valve and choke lever, to prevent engine stalling at lower temperature levels occasioned by an opening of the choke valve and throttle valve position than is dictated by the temperature conditions, the second spring being movable from a first position at low temperatures projecting into the path of movement of the pin to a second position at higher temperatures withdrawn from the path of movement of the pin, and a heater element associated with the second spring heating the second spring and effecting a faster movement of the second spring from the first to second positions than would normally occur by exposure of the first spring to the engine temperature sensitive heating means or ambient temperature conditions alone.

* * * * *